US006797063B2

(12) United States Patent
Mekias

(10) Patent No.: US 6,797,063 B2
(45) Date of Patent: Sep. 28, 2004

(54) DISPENSING APPARATUS

(75) Inventor: Kader Mekias, Sachse, TX (US)

(73) Assignee: FSI International, Inc., Chaska, MN (US)

( * ) Notice: Subject to any disclaimer, the term of this patent is extended or adjusted under 35 U.S.C. 154(b) by 0 days.

(21) Appl. No.: 10/255,370

(22) Filed: Sep. 26, 2002

(65) Prior Publication Data

US 2003/0075555 A1 Apr. 24, 2003

Related U.S. Application Data

(60) Provisional application No. 60/326,436, filed on Oct. 1, 2001.

(51) Int. Cl.[7] ..... B05C 11/00; F04B 43/00

(52) U.S. Cl. ..... 118/52; 118/320; 222/94; 222/106; 417/479; 417/275; 417/442; 251/5; 251/61; 137/225

(58) Field of Search ..... 222/94, 96, 106, 222/131, 134, 631–633; 417/479, 275, 442, 480; 118/52, 320; 251/5, 61, 61.1; 137/225, 226; 210/242.1

(56) References Cited

U.S. PATENT DOCUMENTS

| | | | | |
|---|---|---|---|---|
| 3,007,416 A | | 11/1961 | Childs | |
| 3,048,121 A | | 8/1962 | Sheesley | |
| 3,427,987 A | | 2/1969 | Eull | |
| 3,495,540 A | | 2/1970 | Edwards | |
| 3,679,331 A | | 7/1972 | Kushner | |
| 3,717,176 A | * | 2/1973 | Smith | 137/601.04 |
| 3,724,973 A | | 4/1973 | Shill | |
| 4,015,914 A | | 4/1977 | Kushner et al. | |
| 4,195,810 A | * | 4/1980 | Lavin | 251/5 |
| 4,294,802 A | | 10/1981 | Johansson | |
| 4,364,716 A | | 12/1982 | Schjeldahl | |
| 4,484,698 A | | 11/1984 | Starr | |

(List continued on next page.)

FOREIGN PATENT DOCUMENTS

| | | |
|---|---|---|
| DE | 874199 | 4/1953 |
| DE | 29913774 | 3/2000 |
| EP | 0625639 | 11/1994 |
| EP | 0989090 | 3/2000 |
| FR | 1446088 | 7/1966 |

(List continued on next page.)

OTHER PUBLICATIONS

PCT International Search Report for PCT/US02/30724, completed Dec. 17, 2002.

*Primary Examiner*—Richard Crispino
*Assistant Examiner*—Michelle Acevedo Lazor
(74) *Attorney, Agent, or Firm*—Kagan Binder, PLLC

(57) ABSTRACT

Described are dispensing apparatuses and methods of their use, the dispensing apparatuses having one or more process chamber inside of a control chamber, and the volume of the process chamber increases or decreases by adding or removing control fluid from the control chamber, with proper valving, to cause fluid to flow into and out of the process chamber, for use in dispensing fluid, especially in precise amounts.

20 Claims, 4 Drawing Sheets

U.S. PATENT DOCUMENTS

| | | | | | |
|---|---|---|---|---|---|
| 4,778,532 | A | | 10/1988 | McConnell et al. | |
| 4,950,134 | A | | 8/1990 | Bailey et al. | |
| 5,085,560 | A | | 2/1992 | Thompson et al. | |
| 5,316,181 | A | | 5/1994 | Burch | |
| 5,490,765 | A | | 2/1996 | Bailey et al. | |
| 5,527,161 | A | | 6/1996 | Bailey et al. | |
| 5,535,983 | A | * | 7/1996 | Hohermuth | 251/5 |
| 5,593,290 | A | | 1/1997 | Greisch et al. | |
| 5,665,200 | A | | 9/1997 | Fujimoto et al. | |
| 5,718,567 | A | | 2/1998 | Rapp et al. | |
| 5,931,648 | A | | 8/1999 | Del Canizo | |
| 5,946,920 | A | * | 9/1999 | Clarke | 62/50.1 |
| 5,947,702 | A | | 9/1999 | Biederstadt et al. | |
| 5,954,911 | A | | 9/1999 | Bergman et al. | |
| 6,102,361 | A | * | 8/2000 | Riikonen | 251/5 |
| 6,106,246 | A | | 8/2000 | Steck et al. | |
| 6,107,203 | A | | 8/2000 | Vanell | |
| 6,302,660 | B1 | | 10/2001 | Kurita et al. | |
| 6,325,932 | B1 | | 12/2001 | Gibson | |
| 6,348,124 | B1 | | 2/2002 | Garbett et al. | |
| 6,367,669 | B1 | | 4/2002 | Au et al. | |
| 6,419,841 | B1 | | 7/2002 | Snodgrass et al. | |

FOREIGN PATENT DOCUMENTS

| | | | |
|---|---|---|---|
| GB | 2057067 | | 3/1981 |
| JP | 55053419 | | 4/1980 |
| JP | 59096735 | | 6/1984 |
| JP | 61080825 | | 4/1986 |
| JP | 63250824 | | 10/1988 |
| JP | 01212466 | | 8/1989 |
| JP | 02066183 | | 3/1990 |
| JP | 03201432 | | 9/1991 |
| JP | 03260085 | | 11/1991 |
| JP | 04051534 | | 2/1992 |
| JP | 5005644 | A2 | 1/1993 |
| JP | 05047732 | | 2/1993 |
| JP | 09051029 | | 2/1997 |
| JP | 09289182 | | 11/1997 |
| JP | 2000141207 | | 5/2000 |
| JP | 2000153448 | | 6/2000 |
| JP | 2000153450 | | 6/2000 |
| JP | 2001071244 | | 3/2001 |
| JP | 2001203196 | | 7/2001 |
| JP | 2001257197 | | 9/2001 |
| TW | 0379161 | B | 1/2000 |
| TW | 0454317 | B | 9/2001 |
| TW | 0466301 | B | 12/2001 |
| TW | 0466553 | B | 12/2001 |
| WO | WO 91/01464 | | 2/1991 |
| WO | WO 96/08440 | | 3/1996 |

* cited by examiner

Fig. 2 cross section

DISPENSING APPARATUS

This application claims the benefit of provisional application No. 60/326,436 filed Oct. 01, 2001.

FIELD OF THE INVENTION

The invention relates to methods and apparatuses useful in dispensing fluids, especially as applied to high precision process chemical delivery and flow control, and especially but not exclusively with applications for dispensing process fluids in microelectronic device processing.

BACKGROUND

Various commercial and industrial processes involve flow control, pumping, or dispensing of fluids, often requiring or with benefit from high precision. An example is processing of microelectronic devices, which are processed to be cleaned, coated, and recycled. These processing steps can involve dispensing onto a substrate a fluid such as a photoresist material, a developer, a spin-on dielectric material, an etchant, a solvent, a cleanser, water, or another useful fluid. The microelectronic device substrate may include a semiconductor material or assembly, a thin-film "read-write" head, a flat panel display substrate, a fiber optic modulator substrate, or similar known microelectronic devices.

For many reasons, some of which may relate to cost, quality control, uniformity, or general manufacturing efficiency, it can be desirable in many specific applications to precisely control the amount of a fluid applied to a substrate. For example, in spin-coating microelectronic devices, application of a precisely accurate amount of a photoresist material and/or a subsequent developing solution can result in highly accurate and uniform thicknesses of each applied material, allowing very high uniformity of the photoresist and developer coatings, and ultimately allowing quality and consistency in a microelectronic device produced. A different motivation for precise control of a volume of fluid could be where a fluid is a cost-expensive component of a process, such as can also be the case for photoresist materials and other materials involved in processing microelectronic devices.

Industry continues to search for new methods and equipment that offer improved ability to dispense fluids, especially with very accurate and precise volume control.

SUMMARY OF THE INVENTION

The invention relates generally to apparatuses and methods for dispensing fluids. The apparatuses can be useful for dispensing any type of fluids, but may be particularly useful for applying processing fluids to microelectronic devices, especially with semiconductor wafer substrates. The methods and apparatuses relate in general to the use of fluid pressure differentials (e.g., pressure and vacuum) to control the direction and amounts of fluid flow through a chamber by changing the volume of the chamber, e.g., by expanding and compressing the chamber, in combination with opening and closing inlets and outlets of the chamber, preferably allowing for high precision control of the flow of fluid. "High precision" dispensing means that an actual volume of dispensed fluid will be within one percent of a targeted volume.

An apparatus of the invention can include a process chamber at least partially enclosed by a control chamber. The volume of the process chamber can be controlled by adding and removing control fluid to and from the control chamber. An inlet of the process chamber can be connected through a valve to a process fluid reservoir, and an outlet of the process chamber can be connected through a valve to a location of dispense such as a microelectronic device manufacturing apparatus.

An apparatus of the invention can be used to cause flow of a fluid into and out of the process chamber for dispensing, by controlling each of the input and output valves in combination with the volume of the process chamber. Fluid can be drawn into the process chamber through the input valve while the input valve is opened and the outlet valve is closed, and fluid can be expelled from the process chamber while the inlet valve is closed and the outlet valve is opened. The volume of the process chamber can be controlled (i.e., increased and decreased while the valves are opened and closed) by controlling the volume and/or pressure of control fluid in the control chamber, e.g., by adding and removing control fluid to and from the control chamber, or by otherwise increasing and decreasing the pressure inside the control chamber.

One embodiment of an apparatus of the invention can be used to dispense various different process fluids from a single apparatus, by including multiple process chambers connected to different (or the same) fluids, the different process chambers being enclosed in a single control chamber and each being independently valved at an outlet and an inlet.

The fluid dispensed can be any useful fluid, especially a processing fluid, and especially where precise control of the amount of fluid dispensed is desired. Exemplary process fluids for use with the apparatus and methods in the context of processing a microelectronic device include photoresists, developers, solvents, cleaners, water, and other useful processing solutions and fluids, and mixtures thereof.

An aspect of the invention relates to an apparatus for dispensing a fluid to a microelectronic device. The apparatus includes a process chamber enclosed by a control chamber. The inlet of the process chamber can connect to a fluid reservoir. The outlet of the process chamber can connect to a microelectronic device manufacturing apparatus. The volume of the process chamber can be controlled by an amount or pressure of control fluid in the control chamber.

Another aspect of the invention relates to an apparatus for dispensing two or more fluids. The apparatus comprises two or more process chambers inside of one control chamber. Each process chamber includes a fluid input connected to a valve and a fluid output connected to a valve. The volume of each process chamber can be controlled by an amount or pressure of control fluid in the control chamber.

Yet another aspect of the invention relates to a method of dispensing a process fluid in processing a microelectronic device. The method includes providing an apparatus for dispensing a process fluid to a microelectronic device, the apparatus including a process chamber enclosed by a control chamber. An inlet of the process chamber can be connected through a valve to a fluid reservoir. An outlet of the process chamber can be connected through a valve to a microelectronic device manufacturing apparatus. The volume of the process chamber can be controlled by an amount of control fluid added to and removed from the control chamber.

Yet another aspect of the invention relates to a method of dispensing multiple fluids. The method includes providing an apparatus comprising two or more process chambers inside of one control chamber. Each process chamber has a fluid input connected to a valve and a fluid output connected to a valve. A volume of each process chamber can be controlled by an amount or pressure of control fluid in the control chamber.

DETAILED DESCRIPTION

Figure 1:
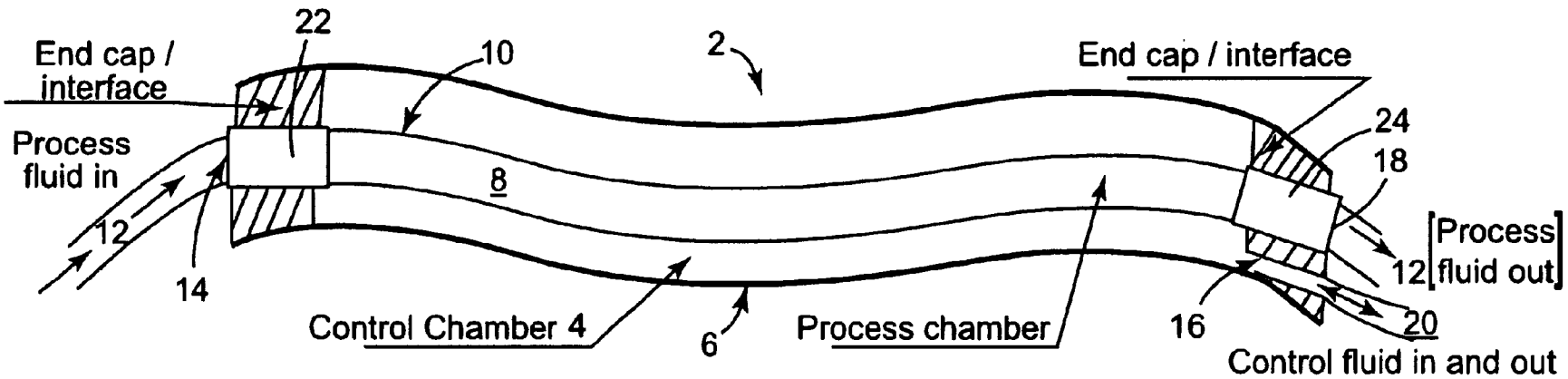
FIG. 1 shows an embodiment of an apparatus of the invention comprising a single process chamber.

The apparatus of the invention includes a control chamber, at least one and optionally multiple process chambers enclosed by the control chamber, valving, and control and process fluids, all arranged to allow control fluid to be added and removed from the control chamber to cause fluid to flow into and out of the process chamber. The apparatus can dispense fluid into and out of the process chamber by controlling the volume of the process chamber, and by valving, e.g., by opening input and output valves of the process chamber. The volume of the process chamber can be controlled by controlling the volume and/or pressure of control fluid in the control chamber, in contact with the process chamber, e.g., by adding and removing control fluid to and from the control chamber.

An exemplary dispensing apparatus of the invention can include a process chamber inside of a control chamber. The exemplary process chamber has an inlet, an inlet valve, an outlet, and an outlet valve. The process chamber can be made of a material that allows the volume of the process chamber to be increased or decreased by applying and reducing pressure to the process chamber material, e.g., a flexible material such as a flexible plastic or rubber tubing. The control chamber can be made of an inflexible material such that changing the pressure or volume of fluid inside the control chamber (containing a process chamber) does not substantially alter the volume of the control chamber, i.e., the change of volume of the control fluid inside of the control chamber will preferentially change the volume of the process chamber instead of the volume of the control chamber. Causing a fluid to flow through the process chamber can be effected as follows. Pressure inside the control chamber is reduced while a process chamber outlet valve is closed, and the process chamber expands and increases in volume to draw process fluid into the process chamber through an open inlet valve. The inlet valve is then closed and pressure in the control chamber can be increased to decrease the volume of the process chamber and expel process fluid from an open outlet valve.

The process chamber can be of any size and shape and made of any material, to be useful according to the overall description herein. Exemplary process chambers can be made of materials that are flexible so that the internal volume of the process chamber can be increased or decreased by applying different pressures to the outside of the process chamber. Preferred process chambers can be made of a tubular material with one example being a tubular fluoropolymer such as tubular Teflon®. Other shapes and materials will also be useful. Any volume can be useful for the process chamber, but for certain embodiments of the invention where high precision dispense techniques are desired, a process chamber volume in the range from about 1 to about 500 milliliters (ml) may be particularly useful. As a more specific example, a process chamber for use with a microelectronic device processing apparatus can be of a size that is about an order of magnitude greater than the volume of a typical dispense; this relative size range can allow for only minor deflection of the material defining the process chamber during dispensing, which can allow for greater precision in dispensing. For a photoresist processing solution, a volume of dispense can be in the range of milliliters, e.g., about 1 to about 5 ml, so a process chamber volume can be in the range of tens of milliliters, e.g., from about 20 to about 40 ml, or about 30 ml. For a photoresist developer solution, a typical volume of dispense can be in the range of tens of milliliters, e.g., 30 to 60 ml, or 40 to 50 ml, so a process chamber volume can be in the range of hundreds of milliliters, e.g., 200 to 400 ml. High precision dispensing of these fluids can mean the actual volume of dispensed fluid will be within one percent of a targeted volume.

Valves can be used to control flow of a process fluid at each of the inlet and the outlet of the process chamber. One of skill will understand that these valves can be of any nature and size suitable for use with the described process chamber and able to control fluid flow at the associated pressures, which for microelectronic processing applications are not exceedingly high, e.g., for semiconductor processing applications can generally be below about 10 atmospheres. A valve may be controlled by a separate (internal or external) control mechanism, mechanically or electronically (preferably by a high-precision electronic feedback control system), or a valve may be a one-way valve that opens and closes based on a pressure differential across the valve, allowing fluid to flow through the valve based on that pressure differential, only in one direction. High-precision valves and controls can be preferable for applications that contemplate dispense of a highly precise amount of fluid, i.e., "high precision dispense."

Also useful in a high precision dispensing apparatus is a high precision, feedback control, pressure regulating system, to control the amount and pressure of control fluid in the control chamber, optionally and preferably in combination with control of inlet and outlet valves of the process chambers. Useful high precision electronic pressure or fluid flow regulating devices will be known by the skilled artisan, and are commercially available from a number of sources, including SMC, of Japan. Preferred such pressure regulating devices can control timing of flow, e.g., timing of opening and closing of input and output valves, to a matter of milliseconds, more preferably to a matter of less than a millisecond, and even more preferably to a matter of much less than a millisecond.

A preferred electronic control system can include one or more pressure sensors such as pressure transducers, to measure pressure of a component of the dispensing apparatus for feedback control such as the control fluid pressure or a process fluid pressure. A pressure sensor can, for example, be located within the control chamber, or multiple separate pressure sensors could be located within one or more process chambers. Either of these arrangements could provide a useful system. However, a single pressure sensor in a control chamber could allow for variability in dispensing a process fluid, due to variabilities in the dispensing apparatus, including variabilities in chamber volumes. A preferred location for a pressure sensor in a spin-coating apparatus for dispensing microelectronic device processing fluids according to the invention, can be at a dispense head inside a processing chamber of a processing apparatus. Placing a pressure sensor at the dispense head of a spin coater can advantageously eliminate certain variabilities associated with the control chamber and process chamber volumes, allowing for improved precision of the volume of dispensed fluid.

The control chamber can be of any size and shape that will be useful to include one or more process chambers and an efficient amount of control fluid. A typical control chamber for use with one or more tubular process chambers, can be tubular, but could also be round, square, or rectangular, etc. The control chamber can be made of material that is relatively inflexible so that the volume of the defined control chamber will not experience a change when exposed to the pressures experienced during use. Exemplary materials could include metals and plastics, e.g. rigid materials such as a rigid tubular polyvinyl chloride, stainless steel, or another metal or hard plastic. The control chamber can be of a size that will be able to efficiently contain the one or more process chambers, at their volumes, and that can additionally contain a workable volume of control fluid.

The process fluid (or simply "fluid") can be any material known to be usefully applied or coated onto a substrate, for processing, manufacturing, or use. Exemplary process fluids for microelectronic device applications include photoresist materials and developer solutions used in photolithographic methods; other materials applied by spin-coating techniques such as dielectric materials, spin-on glass, spin-on dopants, low k dielectrics, or a subsequently-applied developing solution; cleaning materials or etchants such as solvents and other acidic or basic materials; and any other material that can be used in processing a microelectronic device such as a semiconductor wafer, especially where it is useful or desirable to precisely control the amount of the material applied. As just a single example, the inventive method and apparatus could be used to apply a photodefinable spin-on dielectric material (e.g., a polyimide or any other chemistry), and/or a subsequent developer solution.

A variety of microelectronic devices can be processed according to the inventive process, including integrated semiconductor circuits (e.g., semiconductor wafers), display screens comprising liquid crystals, electric circuits on boards of synthetic material (circuit boards), and other commercially significant materials and products.

The control fluid can be any compressible or incompressible fluid, such as air, an inert gas, or any of a variety of known and commercially available hydraulic fluids such as silicones, fluoropolymers, etc.

The inventive dispensing apparatus can be useful with any general type of processing or manufacturing equipment or any specific apparatus, especially those of the type used in processing microelectronic devices and especially where precise dispensing of a process fluid can be useful or advantageous. Examples of such processing apparatuses are generally known and commercially available, and include spin-coating apparatuses such as those described, for example, in Assignee's copending U.S. patent application Ser. No. 09/583,629, entitled "Coating Methods and Apparatuses for Coating," filed May 31, 2000; and Assignee's copending U.S. patent application Ser. No. 09/397,714, entitled "Liquid Coating Device with Barometric Pressure Compensation," filed Sep. 16, 1999; the entire disclosures of each of which are incorporated herein by reference.

FIG. 1 shows an exemplary dispensing apparatus according to the invention. FIG. 1 illustrates apparatus 2 having a control chamber 4 defined by an enclosure (here a tube) 6, and an inner process chamber 8, defined by an inner material (here a flexible tube) 10. Process fluid 12 is supplied at an inlet 14 of the process chamber 8, through valve 22, from a fluid reservoir (not shown). Process chamber 8 is connected at an outlet end 18, through outlet valve 24, to a processing apparatus (not shown). Control fluid 20 is delivered to and removed from control chamber 4 through passage 16. A control apparatus (not shown) for controlling one or both of the pressure or volume of control fluid 20 in control chamber 4 is connected to control chamber 4 through passage 16.

In operation, control fluid 20 is delivered to and removed from control chamber 4, through passage 16, providing a pressure difference between control chamber 4 and process chamber 8, and causing the inner tube 10, and the volume of process chamber 8, to precisely expand and contract on demand. Expansion of process chamber 8 caused by reducing the pressure in, e.g., removing control fluid from, control chamber 4, can (with valve 22 open and valve 24 closed) draw process fluid 12 into process chamber 8 through inlet 14. Contraction of process chamber 8 by increasing pressure or volume of control fluid in control chamber 4 can (with valve 22 closed and valve 24 open) cause process fluid 12 to flow from process chamber 8 through outlet 18. The amount of process fluid dispensed from apparatus 2 can in this way be very precisely controlled.

The dispensing apparatus of the invention, e.g., as illustrated by FIG. 1, can be of any size. One embodiment of a dispensing apparatus of the invention, such as illustrated by FIG. 1, can be miniaturized to fit as close as possible to a dispense head, e.g., inside of a processing chamber as part of a dispense head of a spin processing apparatus. As another embodiment, a dispensing apparatus shown in FIG. 1, but including two or more process chambers, e.g., one for a photoresist fluid and another for a developer solution, can be included in a spin coating apparatus at or near a dispense head.

Also, while FIG. 1 illustrates inlet and outlet valves located in close proximity to the ends of the control chamber and the process chamber, either or both of the inlet and outlet valves could be positioned anywhere else in a system: e.g., inside the control chamber; outside the control chamber; inside a processing apparatus, such as at a dispense head of a spin coating apparatus, at a fluid reservoir, or anywhere else in between.

Figure 2:
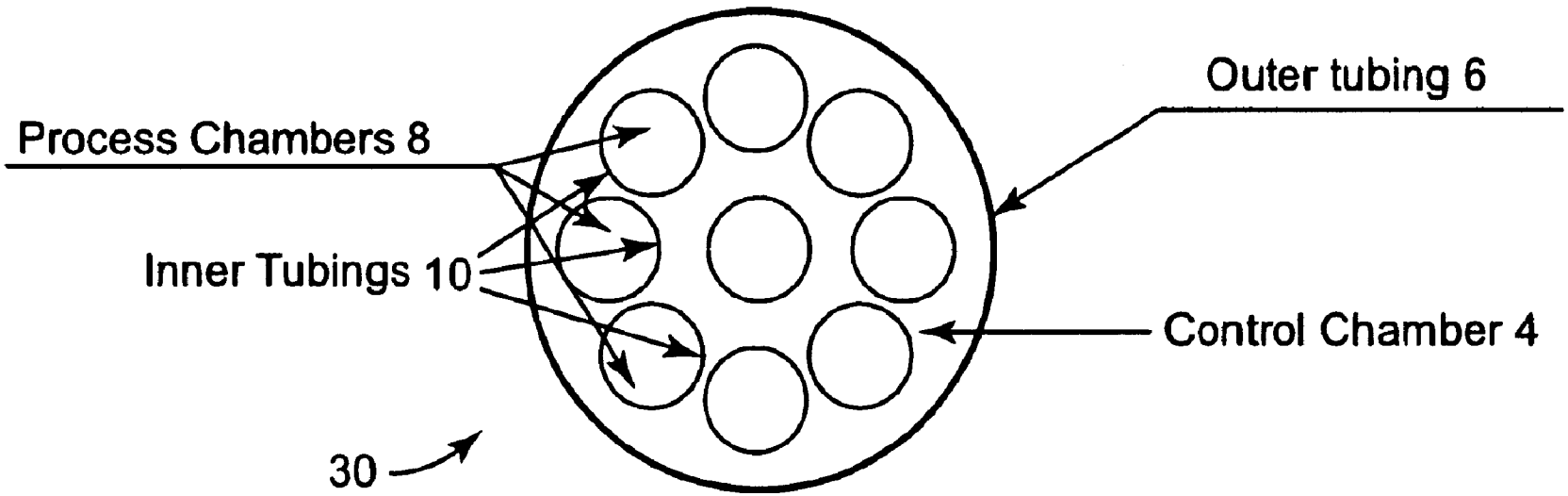
FIG. 2 is an end view of an embodiment of an apparatus of the invention comprising multiple process chambers inside of a single control chamber.

A cross section of an embodiment of a dispensing apparatus 30 of the invention is shown in FIG. 2, which shows multiple process chambers 8 defined by flexible inner tubings 10 located inside of a single control chamber 4 defined by rigid outer tubing 6. Each of the different process chambers 8 can be used as described above to dispense a different (or the same) fluid. For instance, one of the process chambers 8 can be used to dispense a photolithographic photoresist material, and another process chamber 8 of the same apparatus 30 can be used to dispense a developer solution. Any variety of different process solutions can be dispensed to a single piece of equipment such as a microelectronic device processing apparatus.

The same principles described above for a single process chamber apparatus 2 can used to dispense fluids from an apparatus 30 having multiple inner process chambers 8 within a single outer control chamber 4. Each process chamber 8 can be made of a flexible inner tubing material 10 such that the volume of each individual process chamber 8 can be changed by applying pressure to each individual tubing material 10, by changing the volume or pressure of a control fluid in control chamber 4, and with proper operation of individual inlet and outlet valves for each process chamber 8. Flow of a process fluid through any one of the multiple process chambers 8 can be effected as follows. With an inlet valve for a process chamber 8 open, and optionally and preferably with all other inlet and outlet valves of all other process chambers closed, pressure inside control chamber 4 can be reduced to cause the volume of the open-valved-process chamber to expand and draw fluid into that process chamber, without a process fluid being draw into the other process chambers. The open inlet valve is then closed. The outlet valve of that same process chamber can be opened (with all other inlet and outlet valves being closed) and pressure in control chamber 4 can be increased to decrease the volume of the open-outlet-valve process chamber and expel process fluid from the outlet of that process chamber. With proper individual control of each inlet valve and each outlet valve of all of process chambers 8, each chamber can be controlled individually to precisely dispense a fluid with only a single apparatus 30 having a single control chamber 4 and a single control fluid.

Figure 3:
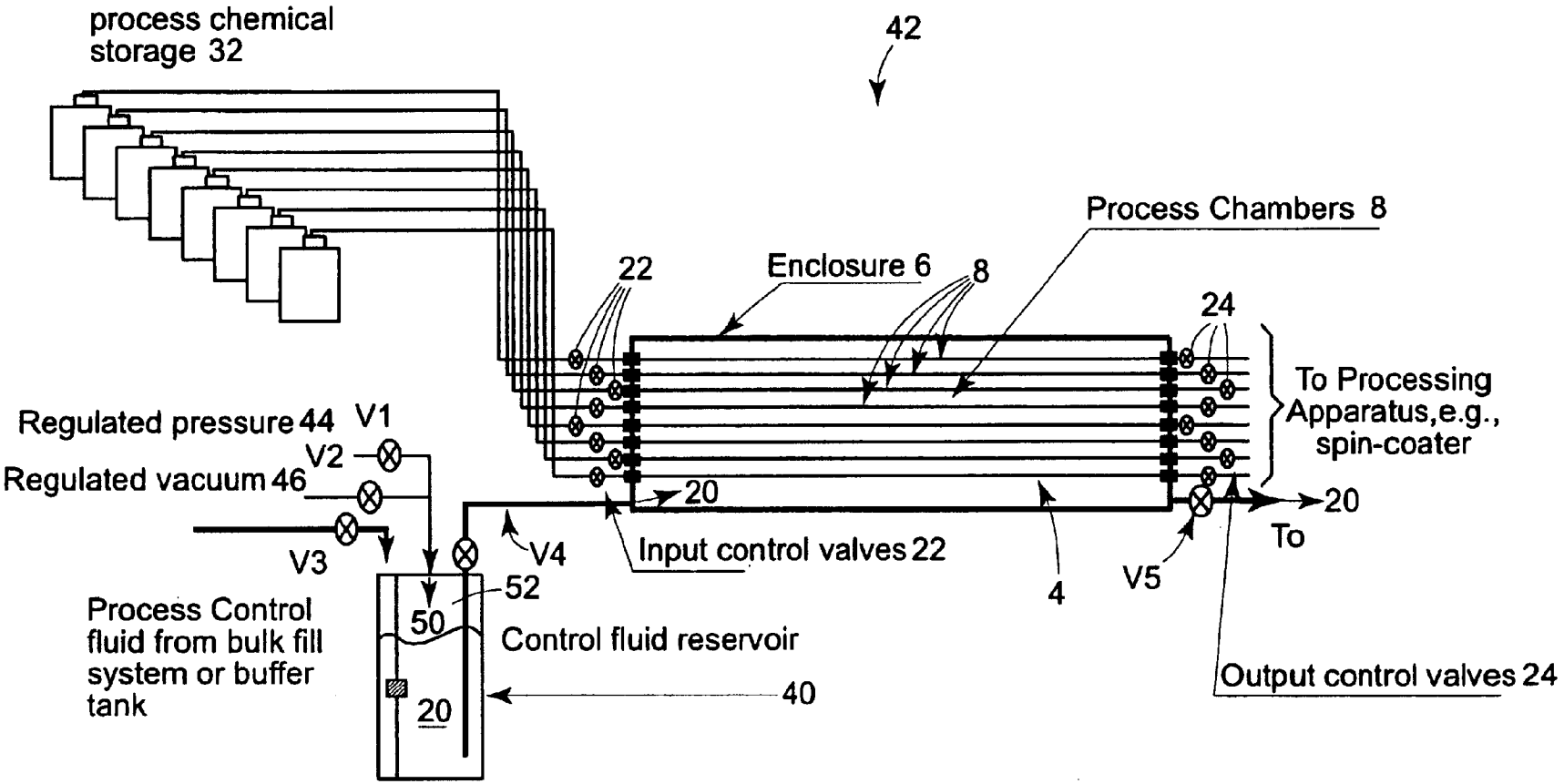
FIG. 3 illustrates an embodiment of an apparatus of the invention that includes multiple process fluids and a control fluid regulated by vacuum.

FIG. 3 illustrates a larger setup exemplifying the dispense apparatus of FIG. 2, wherein multiple process chambers 8 are included in a single control chamber 4. FIG. 3 illustrates a number of process chambers 8, e.g., made of thin-wall TEFLON tubing. Each inner process chamber 8 is connected through a separate inlet valve 22 to one of several fluid reservoirs 32, each of which can contain a different fluid. Each inner process chamber 8 also has its own outlet valve 24 leading to a point of dispense, such as a process bowl of a spin-coating apparatus (not shown). By individually controlling the inlet and outlet valves related to each of the individual process chambers 8, in combination with the pressure and/or volume of control fluid 20 in control chamber 4, any one of the fluids of reservoirs 32 can be precisely dispensed using apparatus 42. In this apparatus 42, the pressure within the control chamber is controlled by a control fluid 20 from a control fluid reservoir 40, the pressure of which is in turn controlled by regulated pressure 44 and regulated vacuum 46. Regulated pressure 44 and vacuum 46 can control a gaseous pressure fluid 50 into headspace 52 of reservoir 40. The gaseous pressure fluid 50 can be, for example, air or an inert gas such as nitrogen. Increasing the pressure or volume of pressure fluid 50 in headspace 52 of reservoir 40 will cause control fluid 20 to flow back and forth between fluid reservoir 40 and control chamber 4. Control fluid 20 can be, for example, a liquid such as water or a hydraulic fluid, e.g., a silicone or fluorocarbon hydraulic fluid, or any other, preferably substantially non-compressible liquid.

Figure 4:
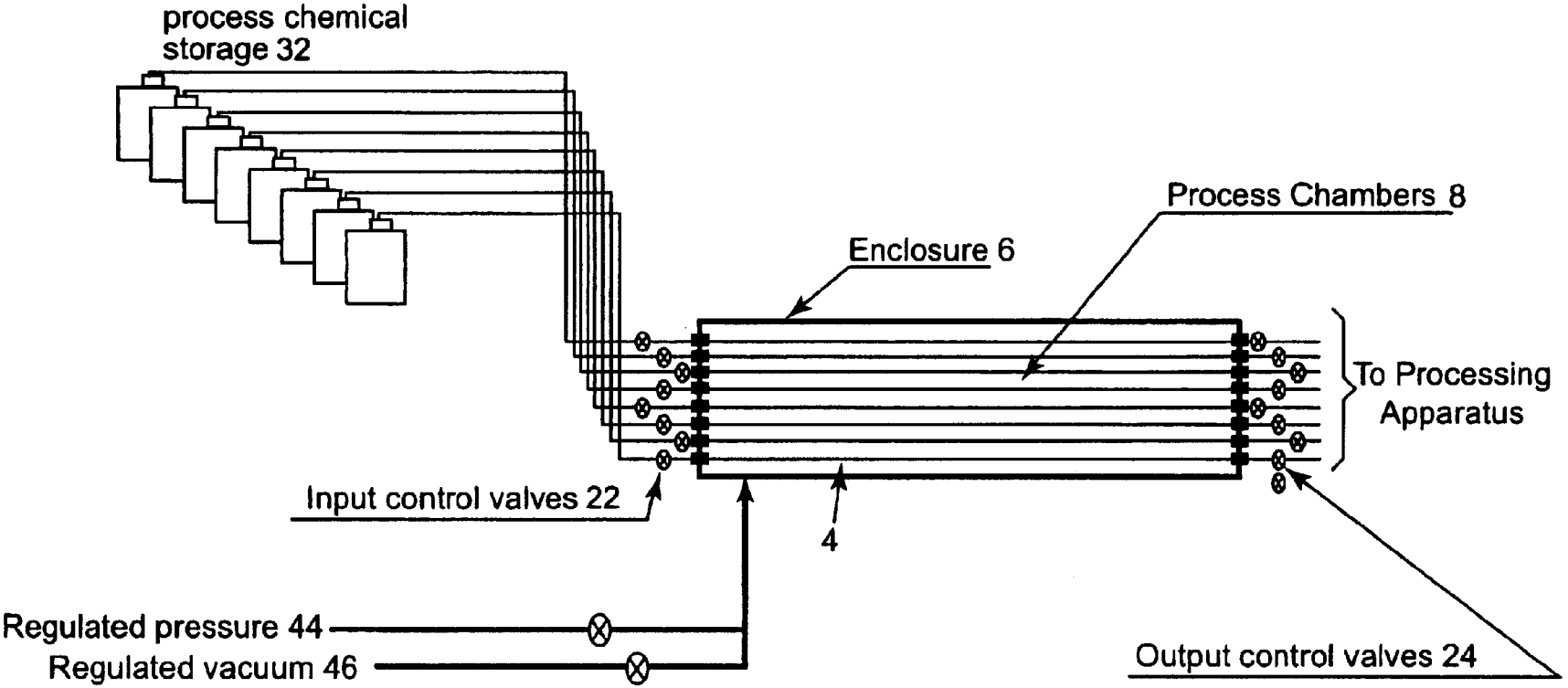
FIG. 4 illustrates an embodiment of an apparatus of the invention that includes multiple process fluids and a gaseous control fluid directly regulating pressure inside the control chamber.

In yet another embodiment, illustrated by FIG. 4, regulated vacuum 44 and regulated pressure 46 can be directly applied to the control chamber 4, with the control fluid in this embodiment being a gaseous fluid such as air or an inert gas such as nitrogen.

As noted, the inventive methods and apparatuses can be used to apply process fluids onto microelectronic devices such as semiconductor wafers, and others. The disclosure specifically describes such applications. But, the invention would be similarly useful in many other applications, as will be understood by the skilled artisan, such as other processing situations where it may be advantageous for any reason (e.g., cost or quality control or uniformity) to control with high precision the amount of a solution applied to any substrate.

What is claimed is:

1. An apparatus for dispensing process fluid to a microelectronic device, the apparatus comprising two or more process chambers enclosed in one control chamber, each process chamber comprising an inlet connected through a valve to a fluid reservoir and an outlet connected through a valve to a microelectronic device manufacturing apparatus, wherein a volume of each process chamber can be independently controlled by use of the valves and an amount or pressure of control fluid in the control chamber.

2. The apparatus of claim 1 wherein the process chamber is defined by a flexible tube.

3. The apparatus of claim 1 wherein the control chamber is defined by a rigid tube.

4. The apparatus of claim 1 wherein the process fluid is selected from the group consisting of a photoresist, a developer, a solvent, a cleaner, water, and mixtures thereof.

5. A microelectronic device processing apparatus comprising the dispensing apparatus of claim 1.

6. A spin-coating apparatus comprising the dispensing apparatus of claim 1.

7. An apparatus for dispensing two or more fluids, the apparatus comprising two or more process chambers inside of one control chamber, each process chamber having a fluid input connected to a valve and a fluid output connected to a valve, wherein a volume of each process chamber can be independently controlled by use of the valves and an amount or pressure of control fluid in the control chamber.

8. The apparatus of claim 7 wherein a process chamber is defined by an at least partially flexible tube.

9. The apparatus of claim 8 wherein the tube comprises a flexible fluoropolymer.

10. The apparatus of claim 7 wherein the control chamber is defined by a rigid tube.

11. The apparatus of claim 10 wherein the rigid tube comprises polyvinyl chloride or stainless steel.

12. The apparatus of claim 7 wherein the control fluid is a liquid.

13. The apparatus of claim 7 wherein the control fluid is a gaseous fluid.

14. The apparatus of claim 7 wherein the process fluid is selected from the group consisting of a photoresist, a developer, a solvent, a cleaner, water, and mixtures thereof.

15. A microelectronic processing apparatus comprising the dispensing apparatus of claim 7.

16. A spin-coating apparatus comprising the dispensing apparatus of claim 7.

17. An apparatus for dispensing process solution, the apparatus comprising two or more process chambers inside of one control chamber, each process chamber having a process solution input connected to a process solution reservoir and a process solution output connected to a spin-coating device, wherein flow of process solution from a process fluid reservoir, through a process chamber, to a spin-coating device, can be independently controlled by use of the valves and an amount or pressure of control fluid in the control chamber.

18. The apparatus of claim 17 comprising a control fluid reservoir in communication with the control chamber, the control fluid reservoir containing liquid control fluid in fluid communication with the control chamber, wherein control fluid flows between the control chamber and the control fluid reservoir to cause flow of process solution from the process solution reservoir to the process chamber.

19. The apparatus of claim 18 wherein the control fluid reservoir comprises liquid control fluid, and headspace containing a compressible fluid, wherein increasing and decreasing pressure of compressible fluid in the headspace adds or removes control fluid to or from the control chamber to cause a volume of a process chamber to increase and decrease.

20. An apparatus for dispensing a fluid to a microelectronic device, the apparatus comprising a process chamber enclosed in a control chambers, an inlet of the process chamber connecting to a fluid reservoir, an outlet of the process chamber connecting to a microelectronic device manufacturing apparatus, and a control fluid reservoir containing liquid control fluid in fluid communication with the control chamber, wherein a volume of the process chamber can be controlled by liquid control fluid flowing between the control fluid reservoir and the control chamber, wherein flow of liquid control fluid between the control fluid reservoir and the control chamber is controlled by compressible fluid in the control fluid reservoir, and wherein the apparatus comprises multiple process chambers within the control chamber, each process chamber comprising an inlet connected to a process solution reservoir and an outlet connected to a microelectronic device spin-coating apparatus wherein a volume of each process chamber can be independently controlled by use of the valves and liquid control fluid in the control chamber.

* * * * *

UNITED STATES PATENT AND TRADEMARK OFFICE

CERTIFICATE OF CORRECTION

PATENT NO. : 6,797,063 B2
DATED : September 28, 2004
INVENTOR(S) : Mekias

It is certified that error appears in the above-identified patent and that said Letters Patent is hereby corrected as shown below:

Column 9,
Line 9, “chambers,” should be -- chamber, --.

Column 10,
Line 11, “apparatus wherein” should be -- apparatus, wherein --.

Signed and Sealed this

Eighth Day of February, 2005

JON W. DUDAS
*Director of the United States Patent and Trademark Office*